US009032771B2

(12) United States Patent
McCallum

(10) Patent No.: US 9,032,771 B2
(45) Date of Patent: May 19, 2015

(54) BENDING DIE WITH RADIAL CAM UNIT

(71) Applicant: Norgren Automation Solutions, LLC, Saline, MI (US)

(72) Inventor: Scott McCallum, St. Clair, MI (US)

(73) Assignee: Norgren Automation Solutions, LLC, Saline, MI (US)

( * ) Notice: Subject to any disclaimer, the term of this patent is extended or adjusted under 35 U.S.C. 154(b) by 0 days.

(21) Appl. No.: 14/313,343

(22) Filed: Jun. 24, 2014

(65) Prior Publication Data

US 2014/0305182 A1 Oct. 16, 2014

Related U.S. Application Data

(63) Continuation of application No. 13/309,695, filed on Dec. 2, 2011, now Pat. No. 8,789,402.

(60) Provisional application No. 61/418,939, filed on Dec. 2, 2010.

(51) Int. Cl.

| | |
|---|---|
| ***B21D 5/01*** | (2006.01) |
| ***B21D 5/04*** | (2006.01) |
| ***B21D 19/02*** | (2006.01) |
| ***B21D 7/024*** | (2006.01) |
| ***B21D 19/08*** | (2006.01) |
| ***B21D 22/08*** | (2006.01) |
| ***B21D 37/08*** | (2006.01) |

(52) U.S. Cl.

CPC *B21D 5/01* (2013.01); *B21D 5/042* (2013.01); *B21D 19/02* (2013.01); *B21D 7/024* (2013.01); *B21D 5/04* (2013.01); *B21D 19/08* (2013.01); *B21D 19/086* (2013.01); *B21D 22/08* (2013.01); *B21D 37/08* (2013.01)

(58) Field of Classification Search

CPC ..... B21D 5/01; B21D 5/04; B21D 5/042; B21D 7/024; B21D 19/02; B21D 19/08; B21D 19/086; B21D 22/08; B21D 37/08

USPC ..... 72/298, 310, 312, 313, 319–321, 387, 72/388, 452.4, 452.9

See application file for complete search history.

(56) References Cited

U.S. PATENT DOCUMENTS

| | | | |
|---|---|---|---|
| 4,045,993 | A | 9/1977 | McCauley |
| 4,558,582 | A | 12/1985 | Meinig |

(Continued)

FOREIGN PATENT DOCUMENTS

| | | | |
|---|---|---|---|
| CN | 1373015 | A | 10/2002 |
| CN | 1467044 | A | 1/2004 |

(Continued)

*Primary Examiner* — David B Jones

(74) *Attorney, Agent, or Firm* — Young Basile Hanlon & MacFarlane P.C.

(57) ABSTRACT

A method for bending a workpiece includes positioning a first bending surface adjacent to the workpiece; positioning a second bending surface adjacent to the workpiece; and moving the first bending surface and the second bending surface linearly toward the workpiece while the second bending surface rotates with respect to the first bending surface such that the first bending surface bends a first portion of the workpiece, the second bending bends a second portion of the workpiece, and the first portion of the workpiece, and the second portion of the workpiece are disposed on a first side of a bend line formed on the workpiece by the first bending surface and the second bending surface.

20 Claims, 7 Drawing Sheets

(56) References Cited

U.S. PATENT DOCUMENTS

| | | | | |
|---|---|---|---|---|
| 5,746,082 | A | 5/1998 | Matsuoka | |
| 5,784,916 | A | 7/1998 | Matsuoka | |
| 6,539,766 | B2 | 4/2003 | Matsuoka | |
| 7,258,030 | B2 | 8/2007 | McCallum | |
| 7,549,311 | B2 | 6/2009 | Break | |
| 7,624,615 | B2 | 12/2009 | Nieschulz | |
| 7,775,081 | B2 | 8/2010 | Genereux et al. | |
| 8,322,181 | B2 * | 12/2012 | Wilson | 72/319 |
| 8,789,402 | B2 * | 7/2014 | McCallum | 72/313 |
| 2004/0163489 | A1 | 8/2004 | McCallum | |

FOREIGN PATENT DOCUMENTS

| | | | |
|---|---|---|---|
| CN | 101767134 | A | 7/2010 |
| EP | 2058061 | | 5/2009 |
| JP | 55171418 | | 12/1980 |
| JP | 56045218 | | 4/1981 |
| JP | S56-045218 | | 4/1981 |
| JP | S61-182616 | U | 11/1986 |
| JP | H01165114 | | 11/1989 |
| JP | 2004-122201 | | 4/2004 |

* cited by examiner

BENDING DIE WITH RADIAL CAM UNIT

CROSS-REFERENCE TO RELATED APPLICATIONS

This application is a continuation of U.S. Non-Provisional patent application Ser. No. 13/309,695, filed on Dec. 2, 2011, which claims the benefit of U.S. Provisional Patent Application Ser. No. 61/418,939, filed on Dec. 2, 2010.

TECHNICAL FIELD

The present invention relates to the field of sheet metal bending, and more particularly, the present invention relates to a bending die for bending sheet metal around a radiused profile shape.

BACKGROUND

Sheet metal bending apparatuses are well-known. Typically, sheet metal bending dies operate by supporting a workpiece between two relatively moveable die portions. For example, the workpiece may be held in a fixed position with respect to a non-moving backing portion of the die, while an anvil portion of the die is moved into contact with the workpiece to bend a portion of the workpiece about a bend line.

While such bending operations are trivial when applied to a planar workpiece, the complexity of the operation is increased substantially when the workpiece has a profiled shape prior to the bending operation. In such a case, the bend line itself is profiled, and the bend must be made in consideration of the profile of the bend line. One typical approach to bending a workpiece at a profiled bend line involves providing two or more anvil portions that are relatively moveable to a fixed backing portion of the die. These anvil portions are typically configured such that each moves along its own line of action, substantially perpendicular to the profile of the workpiece. When the two or more anvil portions first contact the workpiece during the course of the bending operation, there will typically be a gap between the two anvil portions at the location where the anvil portions contact the workpiece. This can cause some inconsistencies or quality issues in the finished workpiece. Furthermore, when the profile includes a radiused shape, the line of action of the anvil portion responsible for bending the part within the radius necessarily does not move normal to the entirety of the radiused portion.

SUMMARY

Bending dies are disclosed herein. In one example, a bending die has a first bending surface and a second bending surface that is rotatable with respect to the first bending surface. The second bending surface rotates with respect to the first bending surface during a bending operation. The first bending surface is engagable with a workpiece during the bending operation to bend a first portion of the workpiece. The second bending surface is engagable with the workpiece during the bending operation to bend a second portion of the workpiece. The first portion of the workpiece and the second portion of the workpiece are disposed on a first side of a bend line that is formed by the bending operation.

In another example, a bending die includes a body. A first bending surface is defined on the body. The bending die also includes a cam unit that is rotatably mounted to the body for rotation between a first position and a second position. A second bending surface is defined on the cam unit. The first bending surface and the second bending surface are positioned adjacent to each other to define a substantially continuous bending surface when the cam unit is in the first position. The bending die also includes a driver. The cam unit rotates with respect to the body from the first position to the second position during a bending operation in response to engagement of the driver with the cam unit.

In another example, a bending die includes a body. A first bending surface is defined on the body. A cam unit is rotatably mounted to the body for rotation between a first position and a second position. A second bending surface is defined on the cam unit. The first bending surface and the second bending surface are positioned adjacent to each other to define a substantially continuous bending surface when the cam unit is in the first position. The bending die further includes a backing die for supporting at least a portion of a workpiece during a bending operation. The first bending surface is engagable with the workpiece during the bending operation to bend a first portion of the workpiece, and the second bending surface is engagable with the workpiece during the bending operation to bend a second portion of the workpiece. The cam unit moves from the first position to the second position during the bending operation.

In another example, a method for bending a workpiece includes positioning a first bending surface adjacent to the workpiece; positioning a second bending surface adjacent to the workpiece; and moving the first bending surface and the second bending surface linearly toward the workpiece while the second bending surface rotates with respect to the first bending surface such that the first bending surface bends a first portion of the workpiece, the second bending surface bends a second portion of the workpiece, and the first portion of the workpiece, and the second portion of the workpiece are disposed on a first side of a bend line formed on the workpiece by the first bending surface and the second bending surface.

In another example, a method for bending a workpiece includes positioning a first bending surface and a second bending surface adjacent to each other to define a substantially continuous bending surface while the second bending surface is in a first rotational position; and rotating the second bending surface with respect to the first bending surface from the first rotational position toward a second rotational position while engaging the first bending surface and the second bending surface with the workpiece to define a bend line on the workpiece.

In another example, a method for bending a workpiece includes placing the workpiece on a backing surface; supporting a body on a mounting structure that is operable to move linearly toward the backing surface from a first position to a second position, wherein a first bending surface is defined on the body; mounting a cam unit to the body for rotation with respect to the body between a first rotational position and a second rotational position, wherein a second bending surface is defined on the body; positioning a driver at a fixed location with respect to the backing surface; and moving the mounting structure from the first position to the second position such that the cam unit engages the driver to cause rotation of the cam unit from the first rotational position to the second rotational position, the first bending surface bends a first portion of the workpiece, and the second bending bends a second portion of the workpiece.

BRIEF DESCRIPTION OF THE DRAWINGS

The description herein makes reference to the accompanying drawings, wherein like-referenced numerals refer to like parts throughout the several views, and wherein.

DETAILED DESCRIPTION

Figure 1:
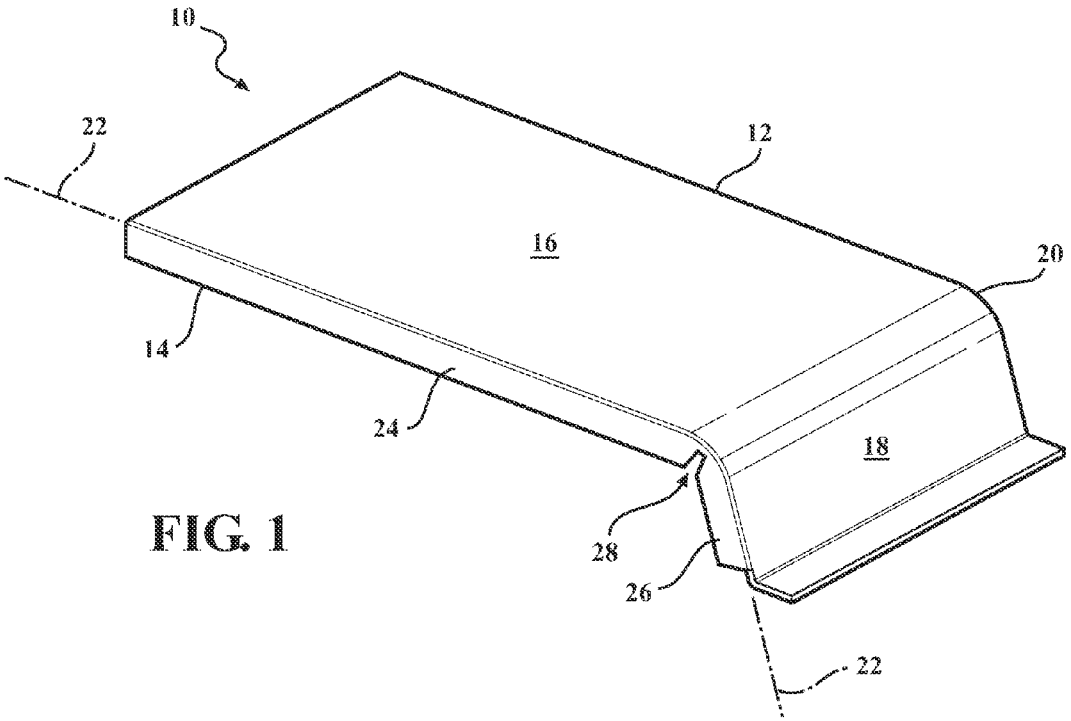
FIG. 1 is a perspective view showing an example of a workpiece having a profiled bend line.
Figure 2:
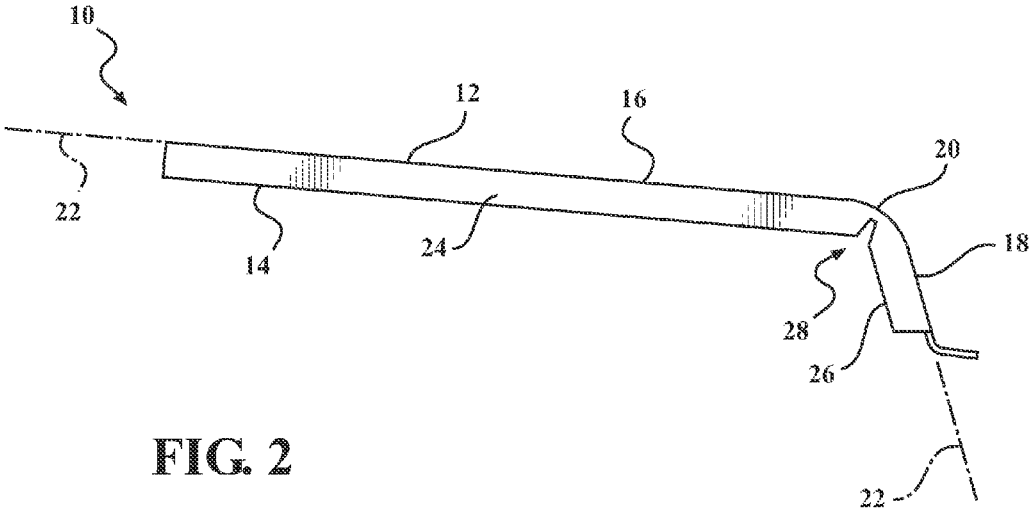
FIG. 2 is a side view of the workpiece of FIG. 1.

FIGS. 1-2 show an example of a workpiece 10 that can be produced using a bending die 100 (FIGS. 3, 4, 6 and 7). The workpiece 10 can be a thin-walled part that is fabricated from sheet metal. The workpiece 10 includes a body portion 12 and a flange portion 14. The body portion 12 has a profiled shape including a first portion 16, a second portion 18, and a radiused portion 20. The first portion 16 and the second portion 18 are each substantially planar but extend at an angle with respect to one another. The radiused portion 20 interconnects the first portion 16 and the second portion 18 by providing a radiused profile between the first and second portions 16, 18.

The body portion 12 and the flange portion 14 meet at a profiled bend line 22. The profiled bend line 22 extends continuously along the body portion 12, including along the first portion 16, the radiused portion 20, and the second portion 18. The flange 14 includes a first portion 24 that is adjacent to the first portion 16 of the body portion 12 and a second portion 26 that is adjacent to the second portion 18 of the body portion 12. The first and second portions 24, 26 of the flange 14 are disposed on the same side of the profiled bend line 22. The first and second portions 24, 26 of the flange 14 meet at a notch 28 that may be provided adjacent to the radiused portion 20 of the body portion 12 in order to facilitate a bending operation by which the flange 14 is formed. Prior to the bending operation, the first and second portions 16, 18 of the body portion 12 are substantially coplanar with the first and second portions 24, 26 of the flange 14.

A bend is defined at the profiled bend line 22 by a bending operation. The bend that is defined at the profiled bend line 22 by the bending operation can be of any desired geometry. For example, a 90° bend can be defined at the profiled bend line 22 by the bending operation.

The workpiece 10 is shown and described herein to allow for understanding of the disclosure. The particular geometry of the workpiece 10 is not critical, and the bending die 100 (FIGS. 3, 4, 6 and 7) can be utilized to form workpieces having other geometries. It is specifically contemplated that the bending die 100 can be utilized to form flange portions along profiled bend lines on workpieces having geometries other than those shown with respect to the workpiece 10.

Figure 3:
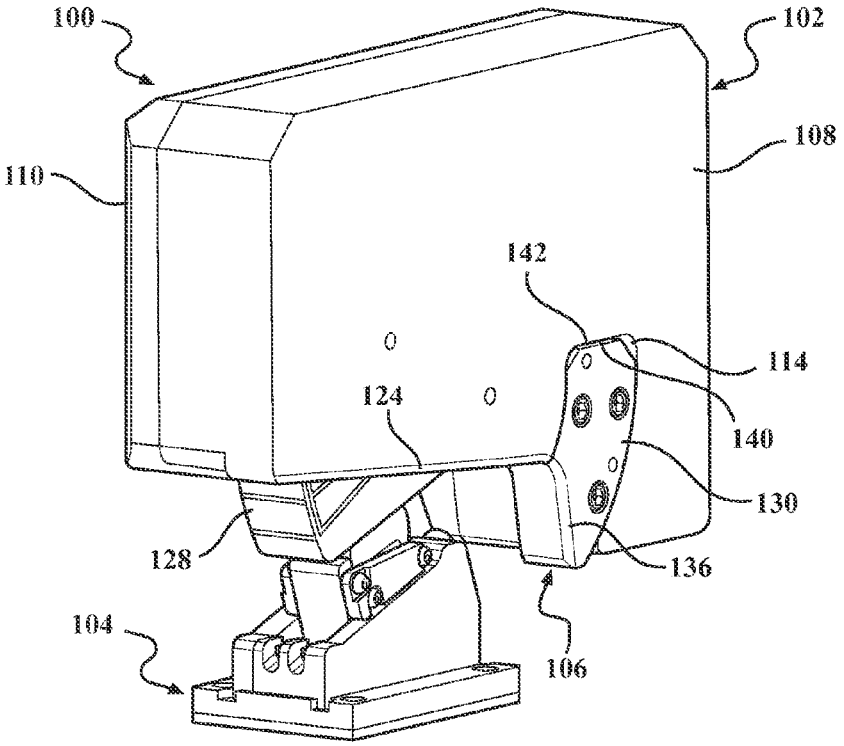
FIG. 3 is a right side perspective view showing a bending die.
Figure 4:
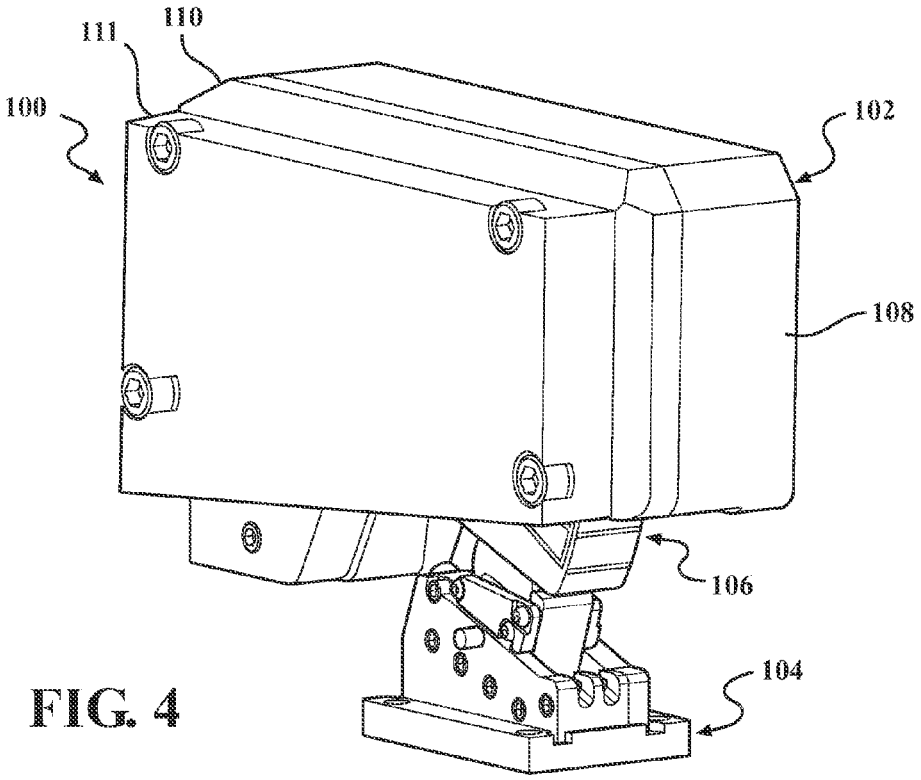
FIG. 4 is a left side perspective view showing the bending die.

The bending die 100, as shown in FIGS. 3-4, is configured to form the flange 14 of the workpiece 10 (FIGS. 1-2). It should be appreciated that the geometry of the bending die 100 in the illustrated example corresponds to the workpiece 10. However, other geometries can be provided for the bending die 100 to accommodate differently configured workpieces. In particular, the bending die 100 can be configured to form flange portions of any selected geometry along radiused bend lines of any selected geometry.

The bending die 100 includes an anvil 102 and a driver 104. At least one of the anvil 102 or the driver 104 is mounted for movement, such as on a press or an actuator. During the bending operation, the anvil 102 and the driver 104 move relative to one another. The bend is formed at the profiled bend line 22 as a result of this relative motion.

In one example, the anvil 102 is mounted for movement with respect to the driver 104. The anvil 102 can be supported by a linear actuator (not shown in FIGS. 3-4), such as a hydraulic press, that moves the anvil 102 along a single line of action in a single direction into and out of engagement with the driver 104. In this example, the driver 104 can be disposed in a fixed position, such that the driver 104 as a whole does not move in response to engagement of the anvil 102 with the driver 104.

In another example, the anvil 102 can be disposed in a fixed position such that it does not move as a whole. In this example, the driver 104 can be supported by a linear actuator (not shown in FIGS. 3-4), such as a hydraulic press, that moves the driver 104 along a single line of action in a single direction into and out of engagement with the anvil 102.

In both examples, the driver 104 can engage the anvil 102 in order to actuate rotational movement of a cam unit 106 that is rotatably supported by the anvil 102. In particular, rotational movement of the cam unit 106 can be actuated by engagement of at least a portion of the driver 104 with the cam unit 106.

In the illustrated example, the anvil 102 moves vertically. It should be understood, however, that any orientation could be utilized. In particular, the bending die 100 can be configured such that at least one of the anvil 102 or the driver 104 is mounted for movement in any direction, such as horizontally, vertically, or at any desired angle.

Figure 5:
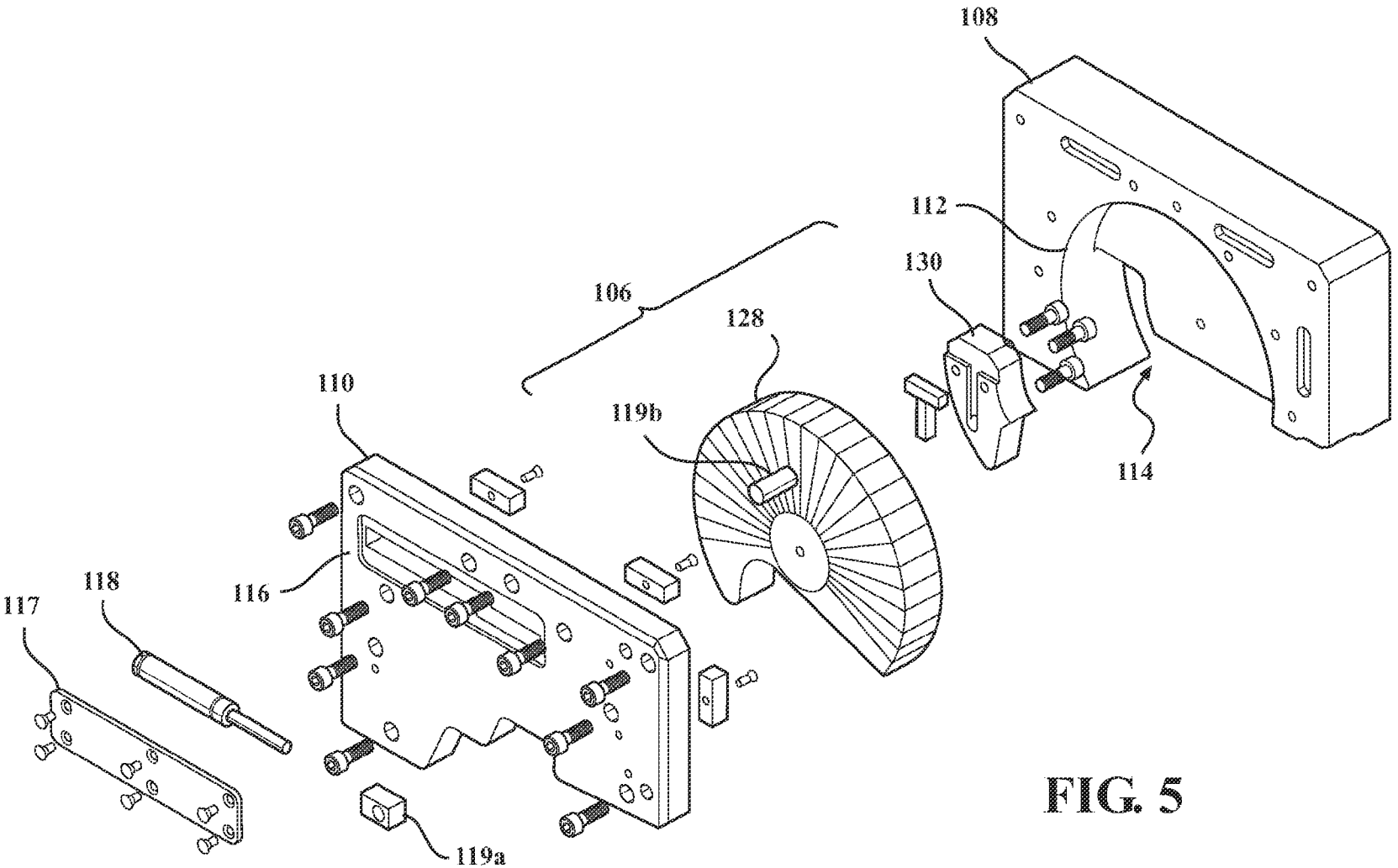
FIG. 5 is an exploded view showing an anvil of the bending die.

As best seen in FIG. 5, the anvil 102 can include a body portion 108, a cover portion 110, and the cam unit 106. The anvil 102 can further include a mounting portion 111 for connecting the anvil 102 to a press or actuator. In the illustrated example, the cam unit 106 is mounted between the body portion 108 and the cover portion 110. More particularly, the cam unit 106 is disposed within an internal cavity 112 that is defined by the body portion 108 of the anvil 102. The internal cavity 112 faces the cover portion 110, such that the cam unit 106 may be installed within the internal cavity 112 of the body portion 108 and retained therein by subsequent assembly of the cover portion 110 with respect to the body portion 108, such that the cam unit 106 is disposed between the body portion 108 and the cover portion 110. As a result, the cam unit 106 is rotatably mounted to the body portion 108 for rotation at least between a first position and a second position. Other configurations can be utilized to mount the cam unit 106 for rotation with respect to the body portion 108.

The cam unit 106 is mounted for rotation with respect to at least part of the anvil 102, such as the body portion 108 and the cover portion 110 thereof. The cam unit 106 can be moveable between the first, or disengaged position, and the second, or engaged position, which will be explained in detail herein. The disengaged and engaged positions can define rotational limits of travel for the cam unit 106.

Figure 6:
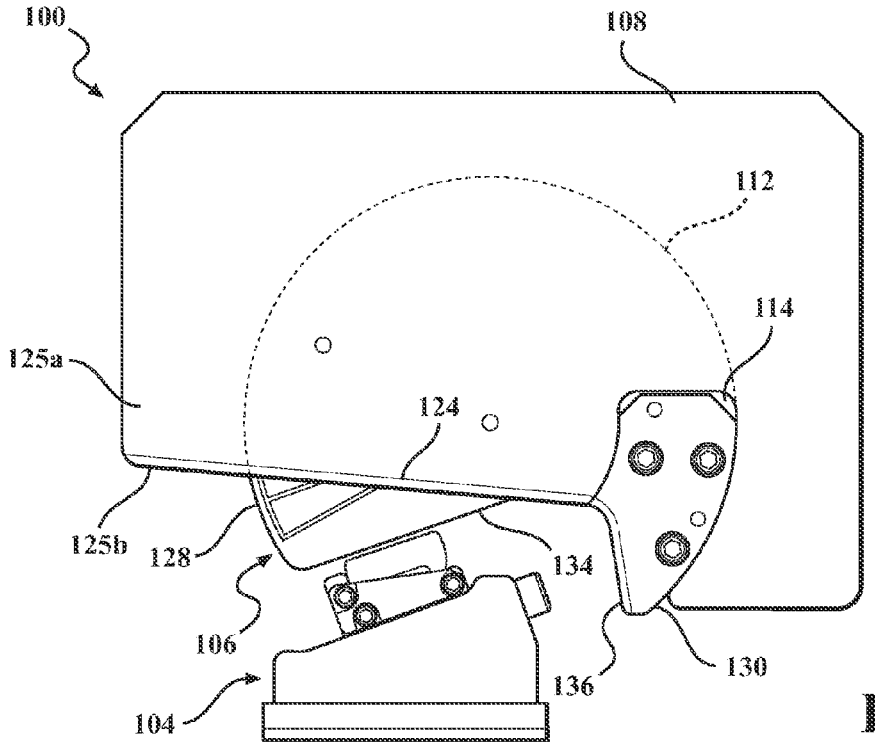
FIG. 6 is a right side view showing the bending die.

Opposite the cover portion 110 of the anvil 102, a cutout 114 can be formed in the body portion 108 to allow a portion of the cam unit 106 to extend laterally out of the internal cavity 112, as best seen in FIG. 6. Also, the internal cavity 112 is open in an area facing the driver 104, such that a portion of the cam unit 106 extends out of the internal cavity 112 for engagement with the driver 104.

To retain the cam unit 106 within the internal cavity 112, however, a periphery of the internal cavity 112 can extend through an arc that is greater than 180°, such that interference between the body portion 108 and the cam unit 106 retains the cam unit 106 within the internal cavity 112. This configuration eliminates the need for an axle or other structure that supports the cam unit 106 with respect to the body portion 108 and the cover portion 110. However, an axle or other supporting structure (not shown) could be provided in order to retain and rotatably support the cam unit 106 with respect to the body portion 108 and the cover portion 110 of the anvil 102. In such a configuration, an interference fit is not needed to retain the cam unit 106 with respect to the body portion 108.

Figure 7:
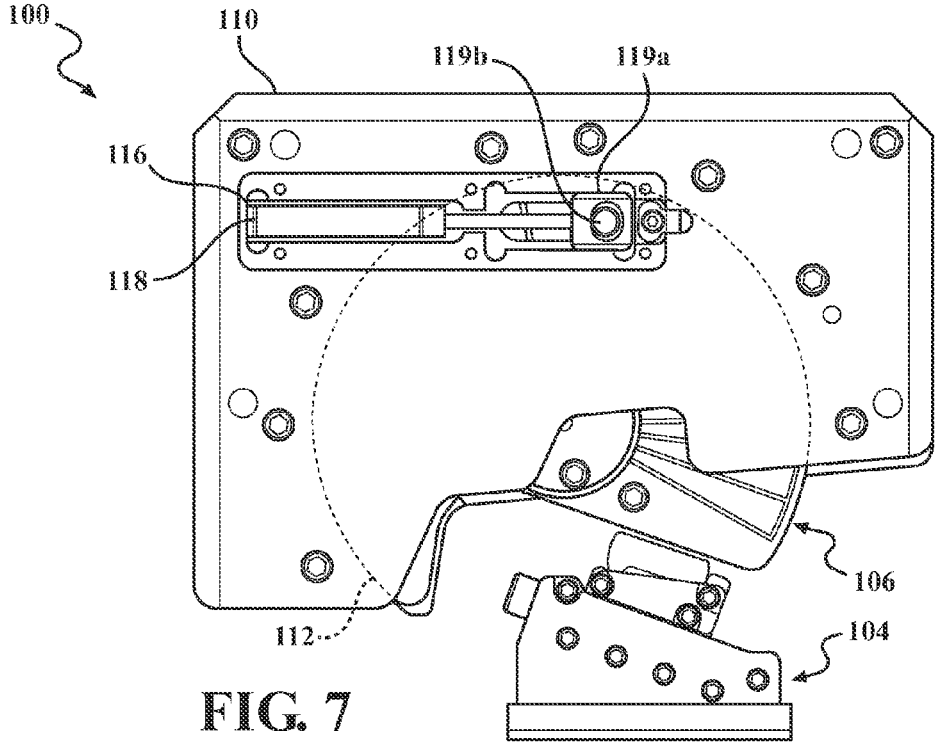
FIG. 7 is a left side view showing the bending die.

A biasing element 118 can be operably connected to the cam unit 106 in order to bias the cam unit 106 toward its disengaged position, as best seen in FIG. 7. In one example, the cover portion 110 can include an opening 116 that extends laterally through the cover portion 110 at a spaced location with respect to an outer periphery of the cover portion 110. The opening 116 provides an area in which the biasing element 118 may be installed. A first portion of the biasing element 118 is disposed in a fixed position with respect to the anvil 102, such as by connection to or engagement with one of the body portion 108 or the cover portion 110 of the anvil 102. A second portion of the biasing element 118 is connected to the cam unit 106, such as by a connector 119*a* and a pin 119*b*. In the illustrated example, the biasing element 118 is a pneumatic cylinder that resists retraction of a piston rod into the cylinder in order to exert a biasing force. Other structures can be used as the biasing element 118, such as a wire spring, an elastic material, or other structures that are able to exert a biasing force, whether in tension, compression, torsion, or otherwise.

Opposite the internal cavity 112, a first bending surface 124 is defined on the body portion 108 of the anvil 102. The first bending surface 124 can be substantially planar and is engageable with the workpiece 10 during the bending operation. The first bending surface 124 can be defined at an edge or corner of the body portion 108 of the anvil 102. In one example, the first bending surface 124 is defined at an edge where an outer surface 125*a* of the body portion 108 meets a lower surface 125*b* of the body portion 108. The first bending surface 124 can be radiused in order to facilitate bending of workpieces without tearing.

Figure 8:
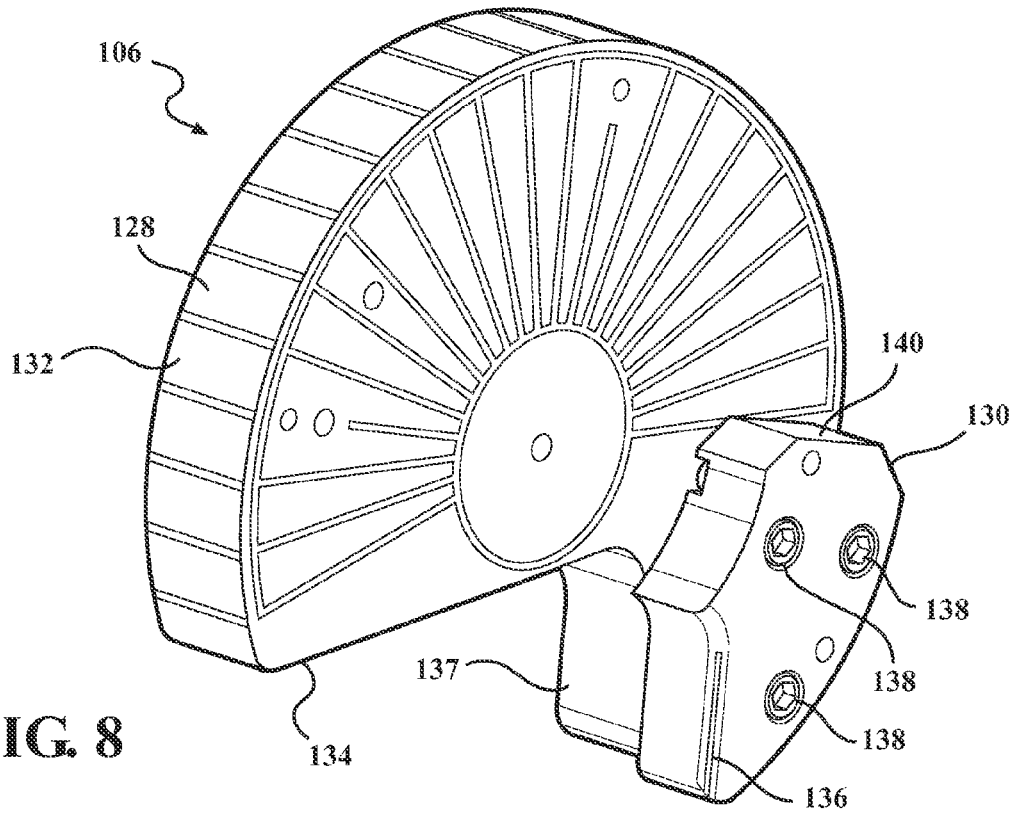
FIG. 8 is a perspective view showing a cam unit of the bending die.

As shown in FIG. 8, the cam unit 106 can include a supporting portion 128 and a cam portion 130. The supporting portion 128 is adapted to be received within the internal cavity 112 of the body portion 108. The supporting portion 128 has an arcuate peripheral surface 132 having a substantially circular shape. In the illustrated example, the arcuate peripheral surface 132 does not, however, define a complete circle. Rather, the arcuate peripheral surface 132 extends along an arc of approximately 270°, from a first surface, namely an engagement surface 134 that is formed on the supporting portion 128 of the cam unit 106 for engagement with the driver 104, to a second surface 137 that is formed on the supporting portion 128 of the cam unit 106 adjacent to a second bending surface 136 that is defined on the cam portion 130. The second bending surface 136 is utilized to form a portion of the flange 14 of the workpiece 10, such as the second portion 26 of the flange 14.

The cam portion 130 of the cam unit 106 can extend laterally outward from the supporting portion 128 of the cam unit 106. The cam portion 130 and the supporting portion 128 may be formed as separate pieces that are formed together, such as by fasteners 138, or may be formed as a unitary structure.

The cam portion 130 is configured to be received within the cutout 114 and the body portion 108 of the anvil 102 for rotation with respect to the body portion 108 of the anvil 102. In this regard, a first limit surface 140 can be provided on the cam portion 130 for engagement with a second limit surface 142 that is defined on the body portion 108 on the periphery of the cutout 114. Engagement of the first limit surface 140 with the second limit surface 142 sets a limit of travel for the cam unit 106 with respect to the body portion 108 and defines the disengaged position of the cam unit 106. The biasing element 118 biases the cam unit 106 toward this limit of travel, such that the first limit surface 140 is brought into engagement with the second limit surface 142 by the biasing element 118 absent application of an external force that overcomes the biasing force that is applied by the biasing element 118. Other features could alternatively be provided to define a limit of radial travel for the cam unit 106.

Figure 9:
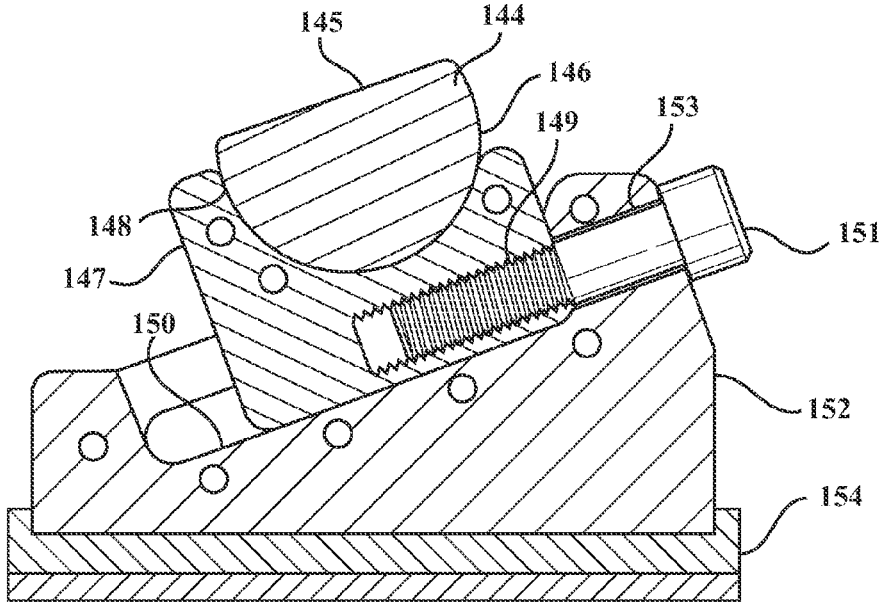
FIG. 9 is a cross-section view showing a driver of the bending die.

In order to rotate the cam unit 106 from the disengaged position to the engaged position during the bending operation, the driver 104 includes an engagement member 144, as shown in FIG. 9. The engagement member 144 can include a substantially planar surface 145 that is adapted to engage the engagement surface 134 of the cam unit 106. The engagement member 144 also includes an arcuate peripheral surface 146. Other configurations can be provided for the engagement member 144, such as a roller.

The engagement member 144 can be supported by a carriage 147. The carriage 147 includes an arcuate recess 148 in which the engagement member 144 is received. The arcuate recess 148 is shaped complementary to the arcuate peripheral surface 146 of the engagement member 144. This allows the engagement member 144 to pivot with respect to the carriage 147. Thus, when the substantially planar surface 145 of the engagement member 144 contacts the engagement surface 134 of the cam unit 106, the engagement member 144 can pivot such that the substantially planar surface 145 maintains a coplanar relationship with respect to the engagement surface 134 of the cam unit 106. In particular, the engagement member 144, as supported by the carriage 147, pivots about an axis that is substantially aligned with an axis of rotation of the cam unit 106.

To allow adjustment of the position of the engagement member 144, the carriage 147 can be disposed on an inclined surface 150 of a sliding mount 152 of the driver 104. The sliding mount 152 allows the longitudinal position of the engagement member 144 and the carriage 147 to be adjusted with respect to the anvil 102, while the sliding mount 152 and a base 154 on which the sliding mount 152 is disposed remain in a fixed position with respect to the anvil 102. In one example, the longitudinal adjustment is performed by rotating a threaded fastener 151 that is disposed within a bore 153 that is formed through the sliding mount 152 adjacent to the inclined surface 150. The threaded fastener 151 is threadedly connected to a threaded bore 149 that is formed in the carriage 147. By rotation of the threaded fastener 151, the threaded connection between the threaded fastener 151 and the threaded bore 149 is advanced or retracted, thereby advancing or retracting the carriage 147 along the inclined surface 150.

During such an adjustment, the engagement member 144 travels along the inclined surface 150 of the sliding mount 152 that is raised or lowered as it is moved in the longitudinal direction with respect to the base. The result of advancing or retracting the position of the engagement member 144 with respect to the anvil 102 is that the distance between the engagement member 144 and an axis of rotation of the cam unit 106 is changed. This changes the degree of rotation of the cam unit 106 in response to being driven by engagement with the engagement member 144 through a linear stroke of a given length.

Figure 10A:
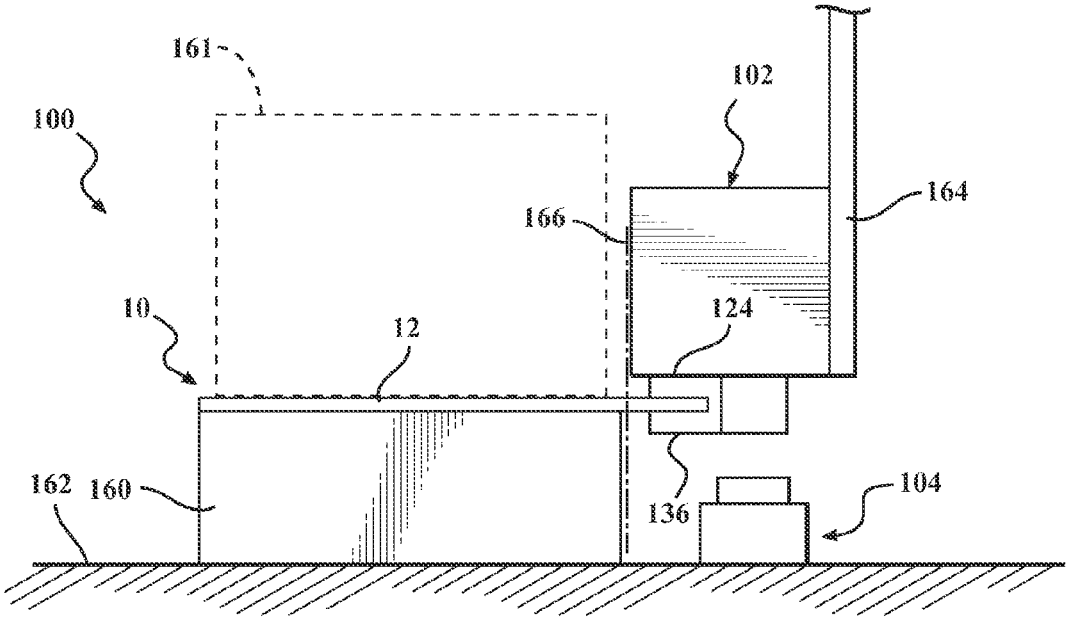
FIG. 10A is a front view showing the bending die positioned with respect to the workpiece prior to a bending operation.
Figure 11A:
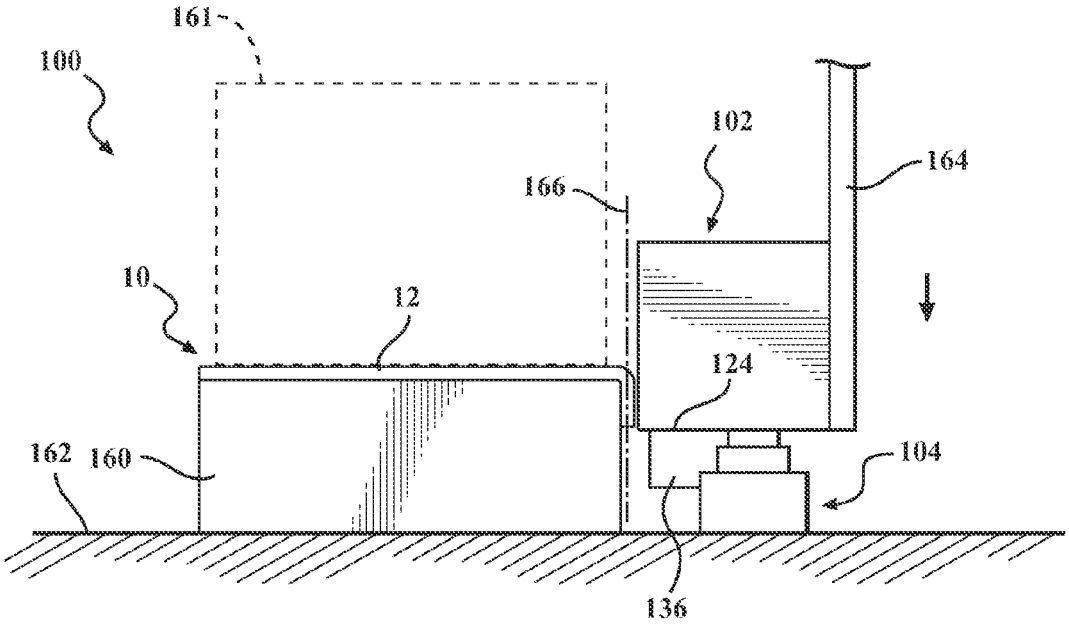
FIG. 11A is a front view showing the bending die positioned with respect to the workpiece subsequent to the bending operation.
Figure 10B:
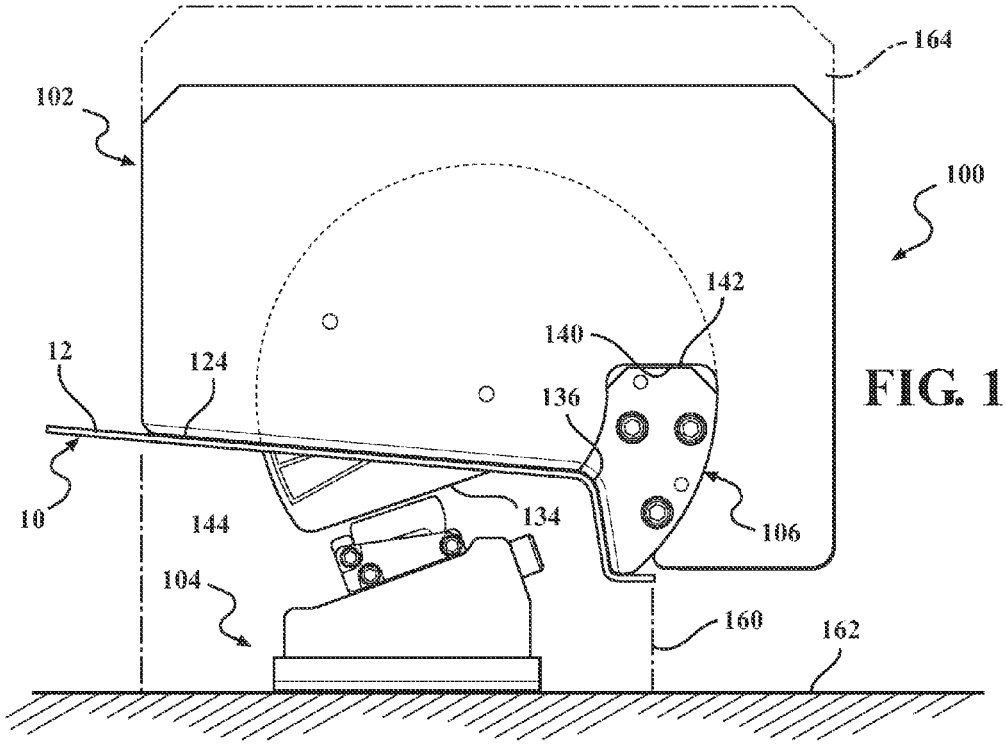
FIG. 10B is a side view showing the bending die positioned with respect to the workpiece prior to the bending operation.
Figure 11B:
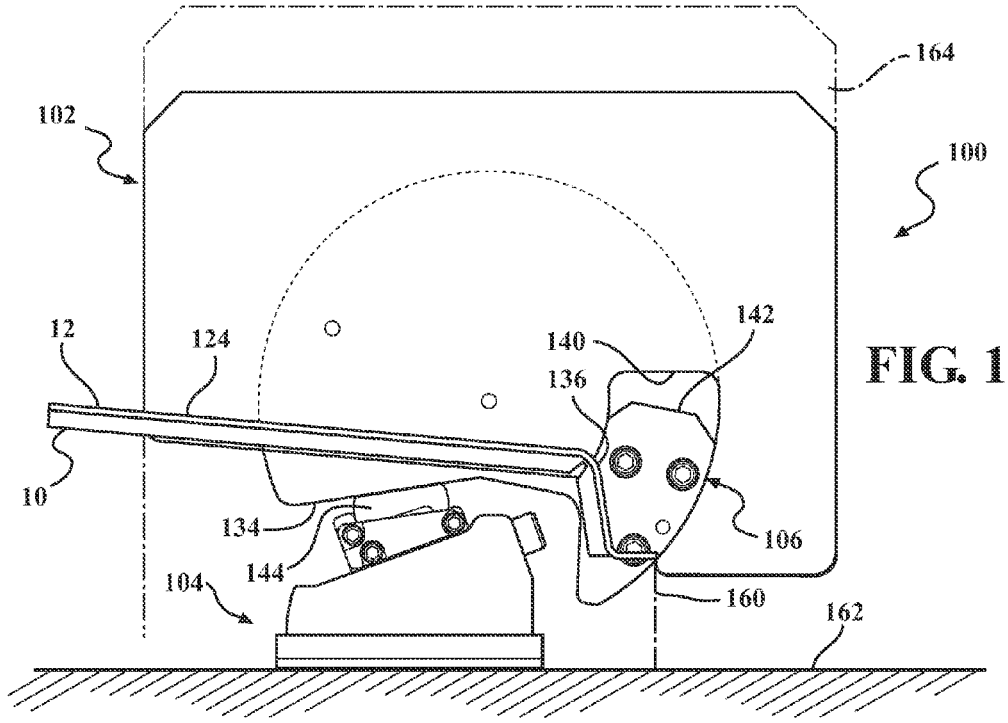
FIG. 11B is a side view showing the position of the bending die relative to the workpiece subsequent to the bending operation.

In use, the workpiece 10 can be supported on a backing die 160, as shown in FIGS. 10A-10B. The backing die 160 holds the workpiece 10 in a fixed position and has a geometric configuration similar to that of the workpiece 10 in its final form after the bending operation. The backing die 160 and the driver 104 can be both fixed to a base surface 162 or other immovable object or objects, such that the backing die 160 and the driver 104 are disposed in a fixed position with respect to one another. The anvil 102 can be supported for upward and downward movement, such as on a linear actuator 164. Alternatively, the anvil 102 can be fixed, and the backing die 160 and the driver 104 can be mounted for movement. An engagement structure, such as an upper holder 161, can be positioned opposite the backing die 160 to maintain the workpiece 10 in secure engagement with the backing die 160. The upper holder 161 can be mounted to the linear actuator 164, an upper die (not shown) or other structure, and may be mounted thereto by resilient means such as a spring.

Initially, with the body portion 12 of the workpiece 10 supported by the backing die 160, the area of the workpiece 10 that will become the flange 14 is not supported by the backing die 160, and the profiled bend line 22 is disposed within a bend plane 166 that lies between the backing die 160 and the anvil 102. At this point, the area of the workpiece 10 that will become the flange 14 is positioned adjacent to the first bending surface 124 and the second bending surface 136 and may be spaced therefrom by a distance sufficient to allow the workpiece 10 to be positioned on the backing die 160 without interference with the bending die 100.

Prior to the bending operation, the anvil 102, including the first and second bending surfaces 124, 136 on the body portion 108 and the cam unit 106, is disposed on a first side of the workpiece 10. The backing die 160 is disposed opposite the anvil 102 on a second side of the workpiece 10. The driver 104 can also be disposed on the second side of the workpiece 10.

Just prior to the bending operation, the bending die 100 is either spaced from the driver 104 or positioned with respect to the driver 104 such that, regardless of contact between the two elements, the cam unit 106 has not been rotated. Thus, the cam unit 106 is in its disengaged position, wherein the first limit surface 140 on the cam unit 106 is in engagement with the second limit surface 142 on the body portion 108 of the anvil 102 under influence of the biasing element 118. At this point, the first bending surface 124 and the second bending surface 136 are positioned with respect to one another such that a continuous bending surface is defined by the first bending surface 124 and the second bending surface 136. This continuous surface that is defined by both the first bending surface 124 and the second bending surface 136 is complementary in shape to the profiled shape of the body portion 12 of the workpiece 10 at the profiled bend line 22. Thus, upon initial contact of the first bending surface 124 and the second bending surface 136 with the workpiece 10, there will be no substantial gaps between the first bending surface 124 and the second bending surface 136.

The bending operation proceeds by moving the anvil 102 of the bending die 100 toward the driver 104 using the linear actuator 164, as shown in FIGS. 10A-10B. As the anvil 102 moves toward the driver 104, the first bending surface 124 and the second bending surface 136 come into engagement with the workpiece 10. Thus, the area of the workpiece 10 that is in engagement with the first bending surface 124 and the second bending surface 136 will begin to bend.

During this motion of the anvil 102 toward the driver 104, the engagement surface 134 of the cam unit 106 comes into engagement with the engagement member 144 of the driver 104. This causes rotation of the cam unit 106, since the resulting rotational force imposed upon the cam unit 106 is greater than the biasing force applied by the biasing element 118. Engagement of the first bending surface 124 with the workpiece 10 bends the first portion 24 of the flange 14. Engagement of the second bending surface 136 with the workpiece 10 bends the second portion 26 of the flange 14. Thus, the linear motion of the first bending surface 124 of the anvil 102 forms the first portion 24 of the flange 14, while the rotational movement of the second bending surface 136 forms the second portion 26 of the flange 14. In this regard, it should be noted that the size and extents of the cam unit 106 and the second bending surface 136 are selected such that the second bending surface 136 on the cam unit 106 extends throughout the entirety of the radiused portion 20 of the body portion 12 of the workpiece 10, thus improving the quality of the bend that is applied in the area of the radiused portion 20.

While the invention has been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method for bending a workpiece, comprising:

positioning a first bending surface adjacent to the workpiece;

positioning a second bending surface adjacent to the workpiece; and forming a bend line by moving the first bending surface and the second bending surface linearly toward the workpiece while the second bending surface rotates with respect to the first bending surface such that the first bending surface bends a first portion of the workpiece at the bend line, the second bending surface bends a second portion of the workpiece at the bend line, and the first portion of the workpiece and the second portion of the workpiece are adjacent to the bend line and disposed on a first side of the bend line.

2. The method of claim 1, wherein at least a portion of the second bending surface is substantially arcuate.

3. The method of claim 1, wherein the first bending surface and the second bending surface are positioned adjacent to each other to define a substantially continuous bending surface prior to moving the first bending surface and the second bending surface.

4. The method of claim 1, wherein the second bending surface rotates with respect to the first bending surface between a first rotational position and a second rotational position.

5. The method of claim 4, wherein the first bending surface and the second bending surface are positioned adjacent to each other to define a substantially continuous bending surface when the second bending surface is in the first rotational position.

6. The method of claim 4, wherein the second bending surface moves from the first rotational position to the second rotational position in response to moving the first bending surface and the second bending surface linearly toward the workpiece.

7. The method of claim 4, wherein the second bending surface is biased toward the first rotational position.

8. The method of claim 1, wherein the second portion of the workpiece has a profiled shape prior to formation of the bend line.

9. The method of claim 8, wherein the profiled shape includes a radiused portion.

10. A method for bending a workpiece, comprising:

positioning a first bending surface and a second bending surface adjacent to each other to define a substantially continuous bending surface while the second bending surface is in a first rotational position; and forming a single bend line using the first bending surface and the second bending surface by rotating the second bending surface with respect to the first bending surface from the first rotational position toward a second rotational position while engaging the first bending surface and the second bending surface with the workpiece.

11. The method of claim 10, wherein the first bending surface and the second bending surface engage a first portion of the workpiece that is disposed on a first side of the single bend line.

12. The method of claim 10, wherein rotating the second bending surface with respect to the first bending surface while engaging the first bending surface and the second bending surface with the workpiece includes moving the first bending surface and the second bending surface linearly toward the workpiece.

13. The method of claim 10, wherein at least a portion of the second bending surface is substantially arcuate.

14. The method of claim 10, wherein the workpiece has a profiled shape prior to defining the single bend line.

15. The method of claim 14, wherein the profiled shape includes a radiused portion.

16. A method for bending a workpiece, comprising:

placing the workpiece on a backing surface;

supporting a body on a mounting structure that is operable to move linearly toward the backing surface from a first position to a second position, wherein a first bending surface is defined on the body;

mounting a cam unit to the body for rotation with respect to the body between a first rotational position and a second rotational position, wherein a second bending surface is defined on the cam unit;

positioning a driver at a fixed location with respect to the backing surface; and moving the mounting structure from the first position to the second position such that the cam unit engages the driver to cause rotation of the cam unit from the first rotational position to the second rotational position, the first bending surface bends a first portion of the workpiece, and the second bending surface bends a second portion of the workpiece such that the first portion of the workpiece and the second portion of the workpiece lie in a common plane.

17. The method of claim 16, wherein the first bending surface and the second bending surface are positioned adjacent to each other to define a substantially continuous bending surface when the cam unit is in the first rotational position.

18. The method of claim 16, wherein at least a portion of the second bending surface is substantially arcuate.

19. The method of claim 16, wherein the second bending surface is biased toward the first rotational position.

20. The method of claim 16, wherein the second portion of the workpiece has a profiled shape before the first bending surface bends the first portion of the workpiece and the second bending surface bends the second portion of the workpiece.

* * * * *